US005519939A

United States Patent [19]

Smith

[11] Patent Number: 5,519,939

[45] Date of Patent: May 28, 1996

[54] HAIR CUTTING DEVICE

[76] Inventor: James E. Smith, 10 Elm St., Saraland, Ala. 36571

[21] Appl. No.: 380,670

[22] Filed: Jan. 30, 1995

[51] Int. Cl.[6] ..... B26B 19/00

[52] U.S. Cl. ..... 30/30; 30/34.2; 30/123

[58] Field of Search ..... 30/30, 31, 34.2, 30/90, 123, 34.05, 34.1, 50; 132/213, 213.1, 214

[56] References Cited

U.S. PATENT DOCUMENTS

| | | | |
|---|---|---|---|
| 183,240 | 10/1876 | Wohl | 30/30 |
| 1,831,579 | 11/1931 | Sneed | 30/50 |
| 2,620,559 | 12/1952 | Verdi . | |
| 2,623,277 | 12/1952 | LeFebre . | |
| 2,624,937 | 1/1953 | Ream . | |
| 2,638,907 | 5/1953 | Boyer . | |
| 2,687,134 | 8/1954 | Bauer . | |
| 2,711,582 | 6/1955 | Scully | 30/90 |
| 2,769,233 | 11/1956 | Duke | 30/34.2 |
| 2,879,777 | 3/1959 | Miller . | |
| 3,029,509 | 4/1962 | Peters . | |
| 3,183,591 | 5/1965 | Dumont | 30/123 R |
| 3,900,949 | 8/1975 | Anzalone . | |
| 4,000,562 | 1/1977 | Alevras . | |
| 4,216,581 | 8/1980 | Van Slooten . | |

FOREIGN PATENT DOCUMENTS

| | | | |
|---|---|---|---|
| 904647 | 11/1945 | France . | |
| 1309398 | 10/1962 | France . | |
| 1336431 | 7/1963 | France | 30/34.2 |
| 951392 | 10/1956 | Germany . | |
| 86050 | 8/1957 | Netherlands | 30/30 |

*Primary Examiner*—Rinaldi I. Rada
*Assistant Examiner*—Allan M. Schrock
*Attorney, Agent, or Firm*—Richard C. Litman

[57] ABSTRACT

A manual hair cutting implement for enabling a person to cut his or her own hair. The implement includes an elongated handle having a brush rotatably mounted thereon, and two combs and two cutting blades. The brush, combs, and blades are mounted on a working head which is pivotally adjustable with respect to the handle, so that the angle therebetween is adjustable. The brush is cylindrical, and has an axis of rotation longitudinally disposed with respect to the handle. The combs and blades are arranged to intersect the periphery of the cylindrical brush, so that hair is appropriately lifted from the head by the brush, maintained in place by the combs, and cut by the blades. The blades are located in a protected position between the handle and brush, and inside the comb, so that exposure of the blade is minimized for safety. The working head is also adjustably mounted to the handle, so that the effective length of the latter is adjustable. The implement enables right and left handed operation, is safe to use, and effectively lifts and holds hair for cutting.

2 Claims, 2 Drawing Sheets

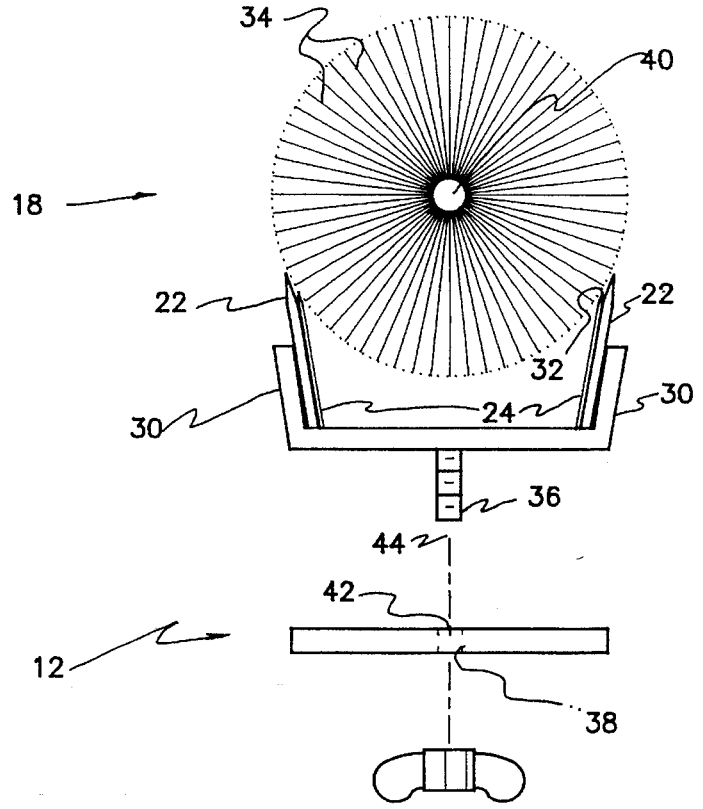
FIG. 3
FIG. 2
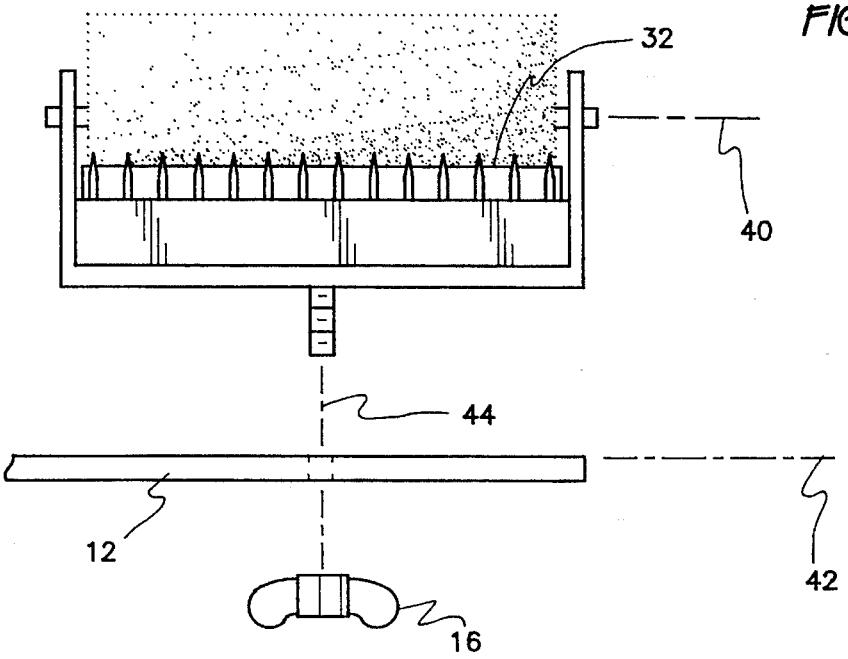

HAIR CUTTING DEVICE

BACKGROUND OF THE INVENTION

1. Field of the Invention

The present invention relates to a manual implement for cutting hair. In particular, the novel implement incorporates a comb, a cutting blade, and a rotary brush for lifting the hair into advantageous position to enable effective cutting by the blade.

2. Description of the Prior Art

The need for hand held cutting implements enabling a user to cut his or her own hair is well established in the prior art. Such implements must hold the hair in an appropriate orientation and then cut the hair to have the intended effect. Three steps are required to achieve the desired result. The first is to lift the hair from the head. The second is to hold the hair steady for cutting, as the blade cuts the strands of hair, and the last is to pass the blade across the hair, thereby cutting it.

Where addressing the first step, the prior art has generally relied on pneumatic pressure to achieve the first step. This is seen in U.S. Pat. Nos. 3,900,949, issued to Robert S. Anzalone on Aug. 26, 1975, 4,000,562, issued to Constantino J. Alevras on Jan. 4, 1977, and 4,216,581, issued to Kevin D. Van Slooten on Aug. 12, 1980. Anzalone provides a powered fan integral to his device. Alevras and Van Slooten rely upon an external vacuum source.

A number of prior art devices provide comb and blade, but lack means for lifting hair. This group is represented by the following U.S. and foreign Patents.

| | | |
|---|---|---|
| 2,620,559 | Michael Verdi | December 9, 1952 |
| 2,623,277 | Walter S. LeFebre | December 30, 1952 |
| 2,638,907 | Mathew L. Boyer | May 19, 1953 |
| 2,687,134 | Frederick Bauer | August 24, 1954 |
| 2,879,777 | John Miller | March 31, 1959 |
| 3,029,509 | George Peters | April 17, 1962 |
| 904,647 | France | November 12, 1945 |
| 1,309,398 | France | October 8, 1962 |
| 951,392 | West Germany | October 25, 1956 |

None of the above inventions and patents, taken either singly or in combination, is seen to describe the instant invention as claimed.

SUMMARY OF THE INVENTION

The present invention provides an uncomplicated, self-contained implement which is independent of electrical power and of external sources of pneumatic pressure. In addition to the usual comb and blade, the novel implement includes a rotary brush which supplants the prior art pneumatic pressure components and schemes, while still providing the function of lifting the hair prior to cutting.

The brush is preferably cylindrical at the periphery of the bristles, and the blade is arranged to contact the brush along a line coinciding with the surface of the cylindrical shape. This enables a broad swath of hair corresponding to the length of the brush and the blade to be cut instantaneously during one pass of the implement against the hair. This is as contrasted to scissor action, where there is a point of contact between adjacent blades, the point of contact moving progressively along the length of the blades.

The implement is arranged to be adjustable as to angle of the brush and blades with respect to the handle, and as to effective length of the handle. Also, two sets of combs and blades are provided on opposing sides of the brush, so that operation in opposite directions is enabled. Thus, the novel implement can be used with both the right and left hands.

Adjustability of handle length accommodates the particular situation of each individual user, with respect to hair length and style prior to cutting. Adjustability of cutting angle also adapts the novel implement for being oriented appropriate for any individual hair style and length.

Incorporation of a rotary brush frees the user from having to work around an electric cord or vacuum hose. Thus, the novel hair cutting implement is quite versatile in its capabilities, and a user has the option to service almost any existing hair style therewith.

Safety is another important consideration. Most implements shield the cutting blade from the user only to a limited degree. It must be stressed that when a person cuts his or her own hair, it is likely that direct viewing of the work is impossible, and that the potential for injurious wielding of an implement increases. The novel implement addresses this concern by locating its cutting blades in a sheltered location inside the combs, and between the rotary brush and the handle.

Accordingly, it is a principal object of the invention to provide a self-contained implement for cutting hair which lifts the hair, maintains the hair in place, and cuts the hair.

It is another object of the invention to render a cutting implement wherein the angle of the blade is adjustable with respect to orientation to the head and hair of the user.

An additional object of the invention is to enable right and left handed operation of the hair cutting implement.

It is a further object of the invention to remain independent of external power and vacuum sources.

Still another object of the invention is to locate the cutting blades safely within the implement.

An additional object of the invention is to provide a rotatable brush integrally with the implement.

It is again an object of the invention to contact the cutting edge of the blade along a line of the brush, whereby a broad swath of hair is cut on a pass of the implement against the hair.

Yet another object of the invention is to enable adjustability of the angle of the blade with respect to the hair.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 2 is an exploded, elevational end view of the invention.

FIG. 3 is an exploded, elevational side view of the invention.

Similar reference characters denote corresponding features consistently throughout the attached drawings.

DETAILED DESCRIPTION OF THE PREFERRED EMBODIMENT

Figure 1:
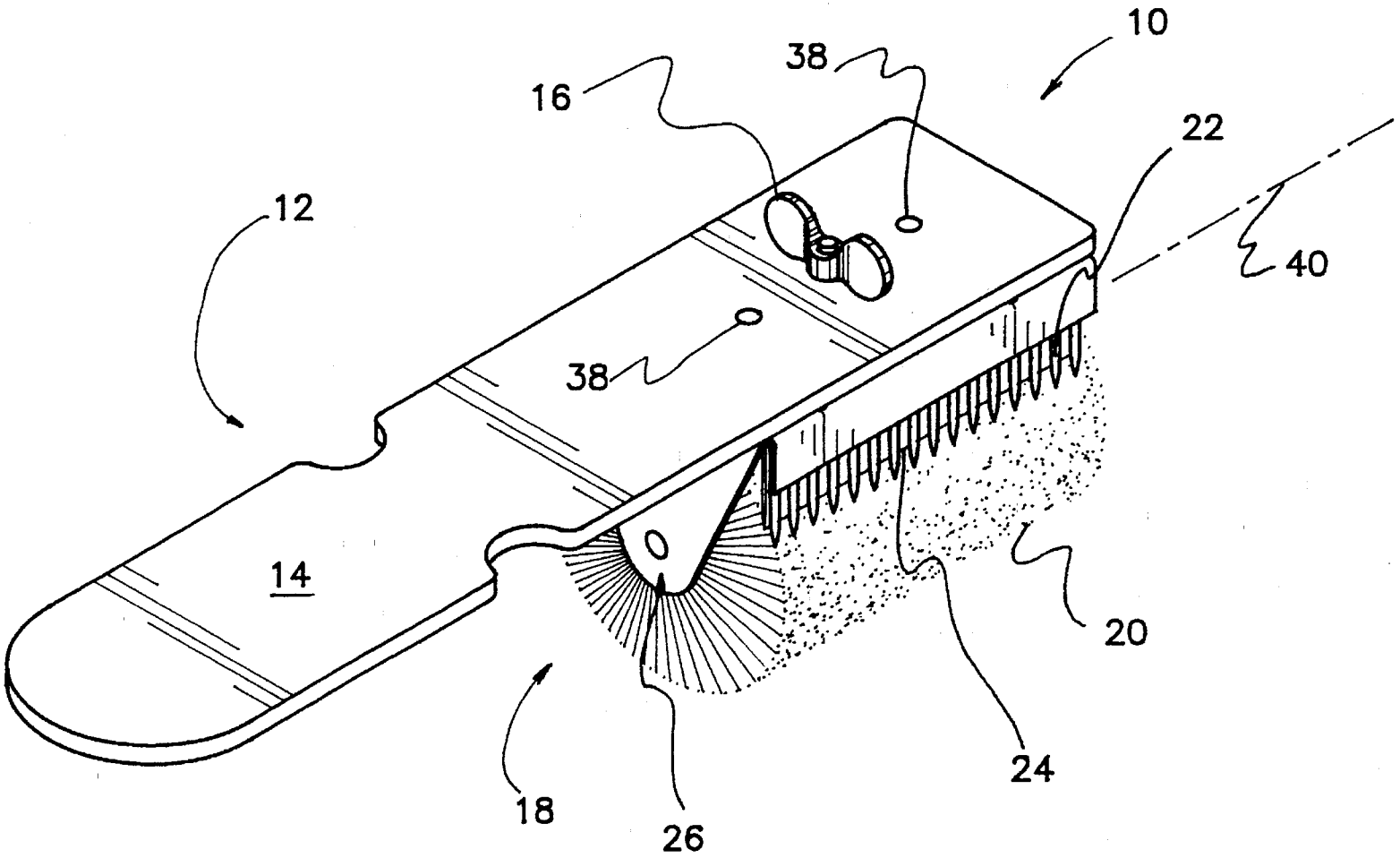
FIG. 1 is a perspective view of the invention.

Turning now to FIG. 1 of the drawings, novel hair cutting implement 10 includes a base member 12 having a handle 14, and providing a base for mounting other components. The remaining components, except for the wing nut 16, are attached to a working head 18. A rotary bristle brush 20, a comb 22, and a cutting blade 24 are mounted on the working head 18. Brush 20 is journaled at 26 to a wall 28 formed as part of working head 18. Brush 20 is thus rotatably mounted to working head 18, and thus to base member 12 when working head 18 is secured in place on base member 12.

FIG. 2 better illustrates working head 18 and the critical relationship of its components. An outer inclined side wall 30 of working head 18 supports comb 22 and blade 24. Examination of FIG. 2 shows that the sharp edge 32 of blade 24 contacts the external periphery of the brush 20 collectively demarcated by the bristles 34 of brush 20. This enables implement 10 to contact and cut a broad swath of hair (not shown) along a line coincident with edge 32. The extent of edge 32 is clearly shown in FIG. 3.

Hair is held by comb 22 at a predetermined orientation with respect to implement 10 for cutting, the hair having been lifted into this orientation by brush 20.

FIG. 2 also shows the attachment of working head 18 to base member 12. Working head 18 has a threaded stud 36 in the base wall thereof which passes through one of several holes 38 formed in base member 12. Wing nut 16 is threaded onto stud 36 to secure working head 18 in a desired working position.

As clearly seen in FIGS. 1 and 3, brush 20 has a rotational axis 40. Edge 32 is parallel to axis 40, so that the hair is uniformly lifted by brush 20 to be held by the teeth of comb 22 against edge 32 of blade 24. Blade edge 32 contacts the periphery of brush 20 along a line, so that a broad swath of hair coinciding with the length of blade 24 and brush 20 is drawn against edge 32 and cut instantaneously.

Safety is promoted by arranging blades 24 to the inside of combs 22, as seen in FIG. 2. The term "inside" signifies that with longitudinal division of base member 12 by a centerline 42 defining the center of base member 12, blades 24 are located between this centerline 42 and combs 22. Blades 24 are offset from centerline 42 at their locations on base member 12, but are closer to centerline 42 than are combs 22. Therefore, a comb 22 is always positioned between a user and a blade 24. It will further be noted that blades 24 are also located between brush 20 and base member 12, so that incidental contact of a user with a blade 24 is difficult.

Provision of a comb 22 and an associated blade 24 on both sides of the device assures that the device will operate regardless of direction of rotation of brush 20, when implement 10 is held against the head. This feature enables right and left handed operation, and also enables the device to operate when drawn both upwardly and downwardly against the hair.

Two adjustments are made possible by holes 38. One adjustment is that the angle of working head 18 with respect to base member 12 may be varied. It will prove awkward to manipulate implement 10 properly at all locations on the head of the user, so that the angle of the user's hand to the head is accommodated by repositioning working head 18 on base member 12. Referring now to FIG. 2, stud 36 has an axis 44. After slackening wing nut 16, working head 18 is angularly adjusted about axis 44 as the user feels is appropriate, and wing nut 16 is tightened. The longitudinal dimension of working head 18, which coincides with brush axis 40, is thus varied with respect to centerline 42.

A second adjustment is made by selecting a different hole 38. Because 3 holes 38 are located at various points along centerline 42, the effective length of handle 14 is varied by this adjustment to suit individual preferences.

It is to be understood that the present invention is not limited to the sole embodiment described above, but encompasses any and all embodiments within the-scope of the following claims.

I claim:

1. A hand held hair cutting implement comprising:

a base member including an elongated handle at one end;

a working head rotatably and removably fastened to said base member at an opposite end of said base member, said working head consisting of two outwardly inclined side walls joined by two end walls and a base wall;

each of said side walls having secured interiorly thereto a comb and a cutting blade, wherein the cutting blade abuts said comb and is interior to said comb;

means for mounting said working head adjustably along a centerline of said base member; and a rotating brush secured between said end walls and parallel to said side walls, said rotating brush having a periphery which intersects said combs; whereby rotation of said brush lifts hair into a preferred orientation to cut a broad swath of hair instantaneously.

2. A hand held hair cutting implement comprising:

a base member including an elongated handle at one end;

a working head rotatably and removably fastened to said base member at an opposite end of said base member, said working head consisting of two outwardly inclined side walls joined by two end walls and a base wall;

each of said side walls having secured interiorly thereto a comb and a cutting blade, wherein the cutting blade abuts said comb and is interior to said comb;

means for angularly adjusting said working head with respect to said base member by providing a wing nut which cooperates with a threaded stud attached to said base of said working head; and a rotating brush secured between said end walls and parallel to said side walls, said rotating brush having a periphery which intersects said combs; whereby rotation of said brush lifts hair into a preferred orientation to cut a broad swath of hair instantaneously.

* * * * *